United States Patent [19]

Tomii et al.

[11] Patent Number: 4,939,413

[45] Date of Patent: Jul. 3, 1990

[54] FLAT TYPE CATHODE RAY TUBE

[75] Inventors: Kaoru Tomii, Isehara; Hiroshi Miyama, Yokohama; Yoshikazu Kawauchi, Kawasaki; Jun Nishida, Shibuya, all of Japan

[73] Assignee: Matsushita Electric Industrial Co., Ltd., Kadoma, Japan

[21] Appl. No.: 134,662

[22] Filed: Dec. 18, 1987

[30] Foreign Application Priority Data

Dec. 19, 1986 [JP] Japan ..... 61-304165

[51] Int. Cl.[5] ..... H01J 29/70

[52] U.S. Cl. ..... 313/422; 313/413; 313/421; 315/366; 315/369; 315/370

[58] Field of Search ..... 313/422, 409, 413, 421; 315/366, 369, 370

[56] References Cited

U.S. PATENT DOCUMENTS

| | | | |
|---|---|---|---|
| 3,005,127 | 10/1961 | Aiken | 313/422 X |
| 4,137,486 | 1/1979 | Schwartz | 313/422 |
| 4,266,159 | 5/1981 | Siekanowicz | 313/422 |
| 4,449,148 | 5/1984 | Inohara et al. | 313/422 X |
| 4,451,758 | 5/1984 | Watanabe et al. | 313/495 |
| 4,525,653 | 6/1985 | Smith | 313/422 |
| 4,622,492 | 11/1986 | Barten | 313/422 |
| 4,745,344 | 5/1988 | Tomii et al. | 358/67 X |

FOREIGN PATENT DOCUMENTS 0079108 5/1983 European Pat. Off. .

*Primary Examiner*—Donald J. Yusko
*Assistant Examiner*—Michael Horabik
*Attorney, Agent, or Firm*—Cushman, Darby & Cushman

[57] ABSTRACT

A flat type cathode ray tube. Electrode beams are vertically emitted from electron beam emitting sources along vertical scanning electrodes which have a strip-shaped configuration in horizontal direction and are insulated from each other and lined up in the vertical direction. The beams turn at a predetermined position toward a phosphor screen for vertically scanning and are horizontally focussed and deflected onto the phosphor screen by horizontal focussing and deflection electrodes.

20 Claims, 11 Drawing Sheets

FIG. 2 (A) (Prior Art)
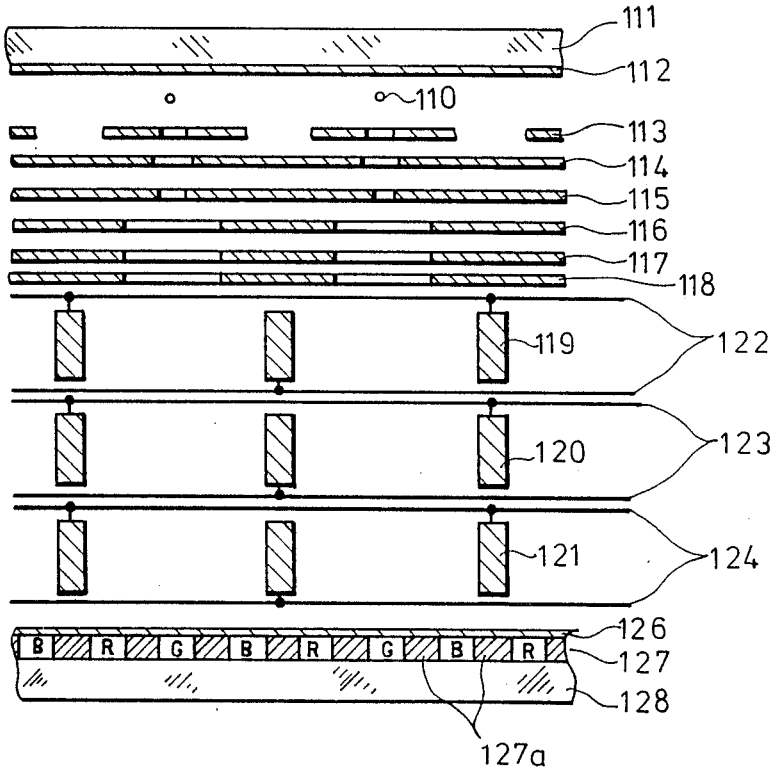
FIG. 2 (B) (Prior Art)
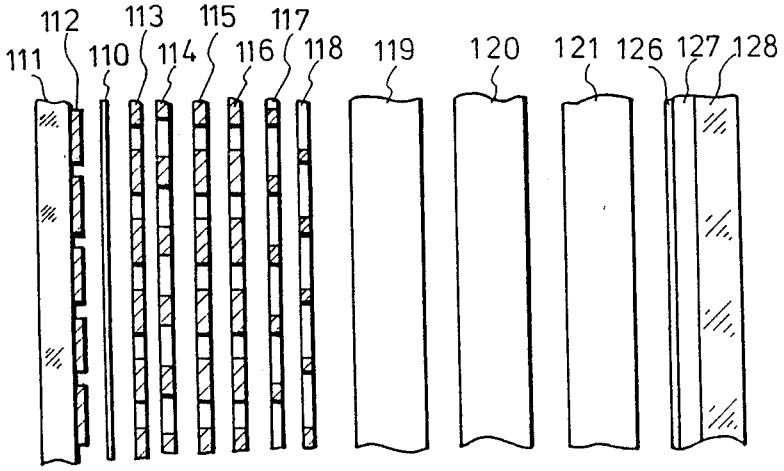

FLAT TYPE CATHODE RAY TUBE

FIELD OF THE INVENTION AND RELATED ART STATEMENT

1. Field of the Invention

The present invention relates to a flat type cathode ray tube which is to be used in a color television set or a computer terminal display.

2. Description of the Related Art

FIG. 1 is a perspective view showing a conventional flat type cathode ray tube disclosed in the Japanese unexamined published Patent Application Sho 61-203545 assigned to the assignee of the present invention. Although a glass enclosure actually encloses all the parts shown in FIG. 1 therein, an illustration of the glass enclosure is omitted in order to show an internal configuration of the flat type cathode ray tube clear. In the figure, horizontal and vertical directions are shown by arrow marks H and V on a face plate 128, respectively, FIG. 1 is illustrated extended in rectangular direction to the H and V-directions for easier illustration. A line cathode 110 has an electron emitting oxide layer on a tungsten wire and is long in the V direction, and a plural number of such line cathodes 110 are disposed in parallel with regular (i.e. equal) intervals in the H-direction making a parallel row. Behind (opposite side to the face plate 128) the row of the line cathodes 110, vertical scanning electrodes 112, which are long strips in the H-direction and are separated to be insulated from each other, are vertically lined up with regular intervals on an insulator panel 111. In an ordinary TV set, the number of the vertical scanning electrodes 112, which respectively form independent electrodes, is selected to be a half number of the horizontal scanning lines (in the case of NTSC system, the number is 480). Between the line cathode 110 and the face plate 128, there exists a first grid 113, a second grid 114, a third grid 115 and a fourth grid 116, from the line cathode 110 toward the face plate 128 in the above-mentioned order. The first grid 113 is formed with plural portions which are divided in H-direction in a manner to be disposed in front of the respective individual line cathodes 110, and the respective portions have apertures corresponding to positions of the vertical scanning electrodes 112. Video signals are applied to the respective portions of the first grid 113 so as to perform beam current modulation. The second grid 114 is formed as a single plate and has apertures similar to that of the first grid 113 and is disposed for extracting the electron beam from the line cathode 110. The third grid 115 has the similar configuration to the second grid 114 and is disposed for shielding between electric field for extracting electron beam and the following electric field. The fourth grid 116 is also formed as a single plate and has apertures which are longer in the horizontal direction than in the vertical direction. FIG. 2(A) is a horizontal sectional view of FIG. 1, and FIG. 2(B) is a vertical sectional view of FIG. 1. In front of the fourth grid 116 (in a direction toward the face plate 128), vertical deflection electrodes 117 and 118, which have similar apertures to the fourth grid 116, are disposed so that each center of the apertures are shifted each other in vertical direction in staggered manner as shown in FIG. 2(B). In front of the vertical deflection electrodes 117 and 118, plural sets of horizontal deflection electrodes which are long in vertical direction are disposed horizontally between adjacent line cathodes 110. In FIG. 1, three sets of horizontal deflection electrodes are shown as an example. That is, a first horizontal deflection electrode 119, a second horizontal deflection electrode 120 and a third horizontal deflection electrode 121 are provided, and are connected to common bus lines 122, 123 and 124 as shown in FIG. 2(A), respectively. The same voltage is applied to the third horizontal deflection electrode 121 as d.c. voltage applied to a metal back electrode 126 of the face plate 128. Voltage for focusing the electron beam is applied to the first horizontal deflection electrode 119 and the second horizontal deflection electrode 120. Light emitting layer comprising a phosphor screen 127 and the metal back electrode 126 is formed on an inner surface of the face plate 128. In case of color displaying, the phosphor screen 127 comprises stripes of red phosphor (R), green phosphor (G) and blue phosphor (B) and black guard bands **127*a*** which are inserted between stripes of adjacent phosphors of different colors one by one.

Next, operation of the above-mentioned conventional flat type cathode ray tube is described with reference to FIGS. 2(A) and 2(B). By flowing current in the line cathodes 110, the line cathodes 110 are heated, and substantially the same voltage as the potential applied to the line cathodes 110 are applied also to the first grid 113 and the vertical scanning electrode 112. At that time, electron beams from the line cathodes 110 travel toward the first grid 113 and the second grid 114 by applying higher voltage (for instance 100–300 V) than the potential of the line cathode 110 to the second grid 114 so that the electron beams pass through respective apertures of the first and second grids 113 and 114. Hereupon, the amount of the electron beams passing through the apertures of the first grid 113 and the second grid 114 is controlled by changing voltage applied to the first grid 113. The electron beams which pass through the aperture of the second grid 114 travel through the third grid 115, the fourth grid 116, the vertical deflection electrodes 117 and 118 and further through spaces formed by parallel disposition of horizontal deflection electrodes 119, 120 and 121. Predetermined voltages are applied to these grids and electrodes so that the electron beams are focused into small beam spots onto the phosphor screen 127. Beam focussing in the vertical direction is made by a static lens which is formed among the third grid 115, the fourth grid 116 and the vertical deflection electrodes 117 and 118, while beam focussing in horizontal direction is made by a static lens which is formed among the horizontal deflection electrodes 119, 120 and 121. The above-mentioned two static lenses are formed only in vertical or horizontal directions, and therefore focussing area of the beam spots can be adjusted individually.

Deflection voltage signal of saw-tooth wave, triangle wave or step like wave having period of horizontal scanning with same voltage is applied to the bus lines 122, 123 and 124 which are connected with the horizontal deflection electrodes 119, 120 and 121, respectively, and thereby the electron beams are deflected within a predetermined width in horizontal direction. The phosphor screen 127 is scanned by these electron beams thereby to display light image.

Vertical scanning of the conventional apparatus is described with reference to FIG. 3(A) and FIG. 3(B). As aforementioned, by controlling voltages of the vertical scanning electrodes 112 thereby to make the potential of the spaces surrounding the line cathodes 110 positive or negative against the potential of the line cathodes 110, generation or ceasing of the electron beams from the line cathodes 110 (hereinafter is referred as ON or OFF, respectively) is controlled, respectively. At this time, when the distance between the line cathode 110 and the vertical scanning electrode 112 is small, the voltage required for controlling the generation and ceasing of the electron beams can be made small. In such a current TV set that uses the interlaced scanning system, in the first field period, the vertical deflection electrodes 117 and 118 are impressed with a predetermined deflection voltage for one field period, and one of the vertical scanning electrodes 112A is impressed with beam-ON voltage for one horizontal scanning period (1H), and the other vertical scanning electrodes 112B-1122 are impressed with beam-OFF voltage. In the next 1H period, only the next one of the vertical scanning electrodes 112B is impressed with the beam-ON voltage, and thereafter, in the similar manner, one vertical scanning electrode in consecutive order is impressed with the beam-ON voltage one after another until the lowest one 1122 is impressed with that voltage; and thereby a first one field period of the vertical scanning is completed. In the subsequent second field, an inverted deflection voltage is applied to the vertical deflection electrodes 117 and 118 for one field period. The vertical scanning electrodes 112 are impressed with the beam-ON voltage signals each for 1H period in the same way as the first one field. At that time, the amplitude of the deflection voltages which are applied to the vertical deflection electrodes 117 and 118 are adjusted so that horizontal scanning lines of the second field are positioned respectively between with those of the first field. As mentioned above, the vertical scanning electrodes 112 are impressed with the same voltage signals both for vertical scannings in the first and the second fields, while the deflection voltages applied to the vertical deflection electrodes 117 and 118 are inverted to each other in the first and second field, and thus one frame of vertical scanning is completed.

Next, a signal processing system, wherein video signals are applied to electron beam deflection electrodes of the cathode ray tube having horizontally plural electron beam generating sources as the above-mentioned flat type cathode ray tube, is described with reference to FIG. 4. A timing pulse generator 144 receives TV synchronous signal 142 and generates timing pulses which drive line memory circuit 145, 146 and a D/A converter 147. Primary color signals, which are demodulated by one of the above timing pulses and comprise three color signals $E_R$, $E_G$ and $E_B$ corresponding to R(red), G(green) and B(blue), are converted into digital signals by an A/D converter 143, and thereby signals for 1H period are inputted to the first line memory circuit 145. When all the signals for 1H period are inputted to the line memory circuit 145, those signals are transferred simultaneously to the second line memory circuit 146, and the next signals for the next 1H period are also inputted to the first line memory circuit 145. The second line memory circuit 146 stores the transferred signals for 1H period, and transfers those signals to the D/A converter (or pulse width converter) 147, and therein those signals are converted into original analogue signals (or pulse width modulation signals). Those analogue signals are amplified by the D/A converter 147 for application to a modulation electrode (namely the first grid) of the cathode ray tube. These line memory circuits are provided for time delaying for a predetermined period.

In the above-mentioned flat type cathode ray tube, since plural electrodes having at least the same plate-shaped electrodes as the phosphor screen are required, the price becomes complicated. Further, very high technique is required to provide correct intervals of the apertures for passing electron beams and uniform size of apertures and to assemble a lot of electrodes with centers of these apertures on the same line.

OBJECT AND SUMMARY OF THE INVENTION

The object of the present invention is to provide a flat type cathode ray tube having a small number of electrodes and simplified construction.

Another object of the present invention is to provide a flat type cathode ray tube of low cost.

In order to achieve the above-mentioned object, a flat type cathode ray tube in accordance with the present invention comprises:

a phosphor screen, a plurality of vertical scanning electrodes which have an oblong configuration in horizontal direction and each other isolated and lined-up in vertical direction thereby to form a substantially parallel plane to the phosphor screen for vertically scanning electron beams onto the phosphor screen by changing potentials which are to be applied thereto, a plurality of horizontal focussing and deflection electrodes which are disposed between the phosphor screen and the vertical scanning electrode and are parallelly lined-up in horizontal direction for horizontally scanning and focussing electron beams within the predetermined ranges onto the phosphor screen, a plurality of electron beam emitting means which are disposed between the vertical scanning electrodes and the horizontal focussing and deflection electrode in each space partitioned by parallelly opposing disposition of the horizontal focussing and deflection electrode for emitting electron beams in substantially vertical direction along the vertical scanning electrode, and a vacuum enclosure for enclosing the above-mentioned parts.

By adopting the above-mentioned construction, the necessary number of plate-shaped electrodes which have at least the same configuration as a phosphor screen is at most one, and thereby inner construction of electrodes is simplified. Therefore, a flat type cathode ray tube which is of very low cost and easy to assemble can be offered.

BRIEF DESCRIPTION OF THE DRAWINGS

FIG. 2(A) is the horizontal sectional view of the flat type cathode ray tube of FIG. 1.

FIG. 2(B) is the vertical sectional view of the flat type cathode ray tube of FIG. 1.

DESCRIPTION OF THE PREFERRED EMBODIMENTS

Figure 1:
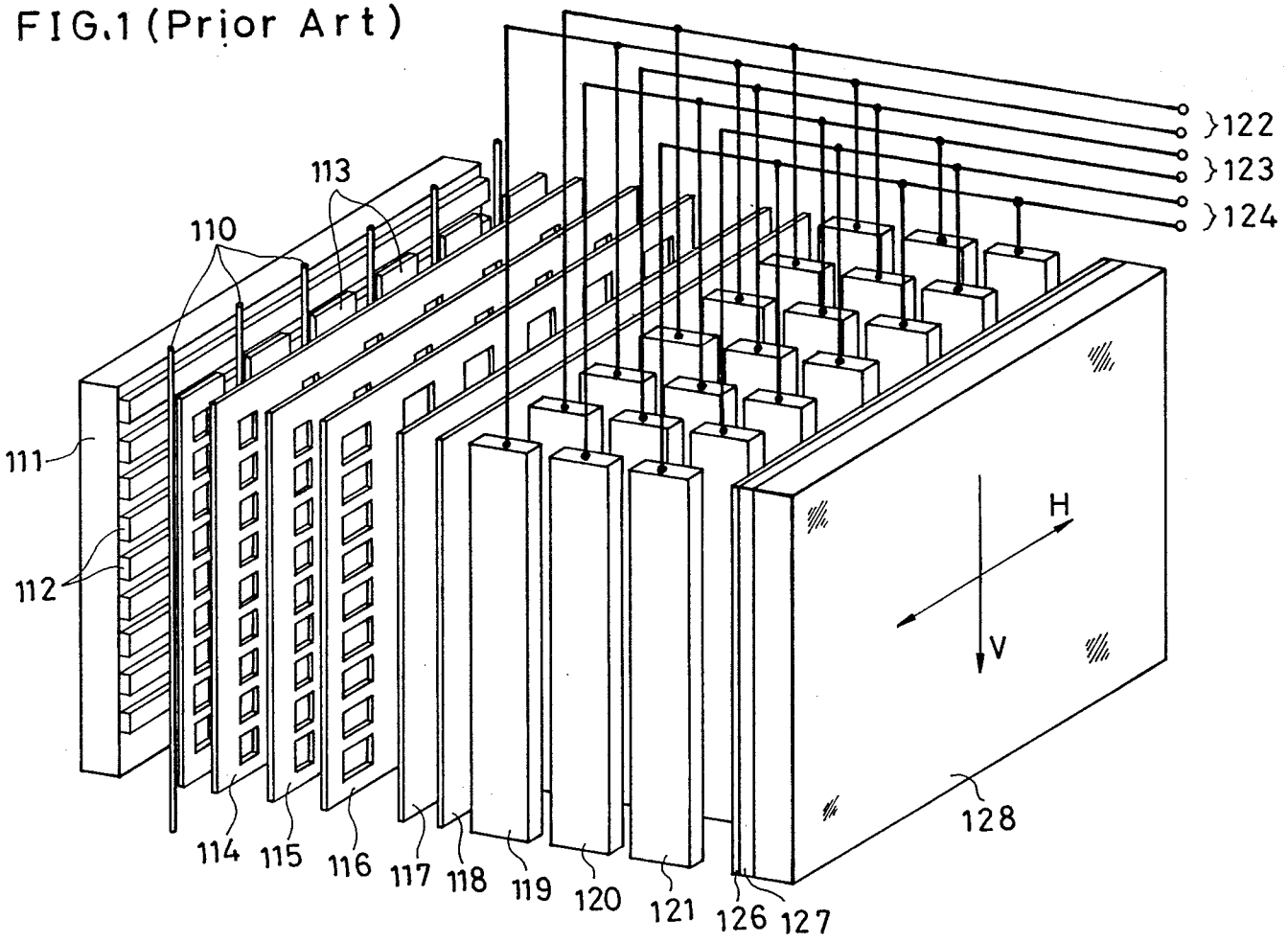
FIG.1 (Prior Art)
FIG. 1 is the partial perspective view showing the conventional flat type cathode ray tube.
Figure 3A:
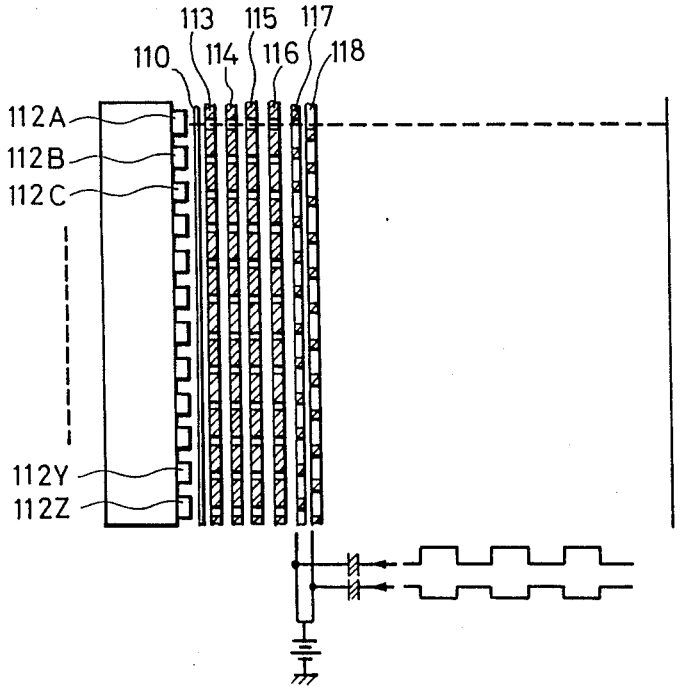
FIG.3(A)(Prior Art)
FIG. 3(A) is the partial vertical sectional view of the flat type cathode ray tube of FIG. 1.
Figure 3B:
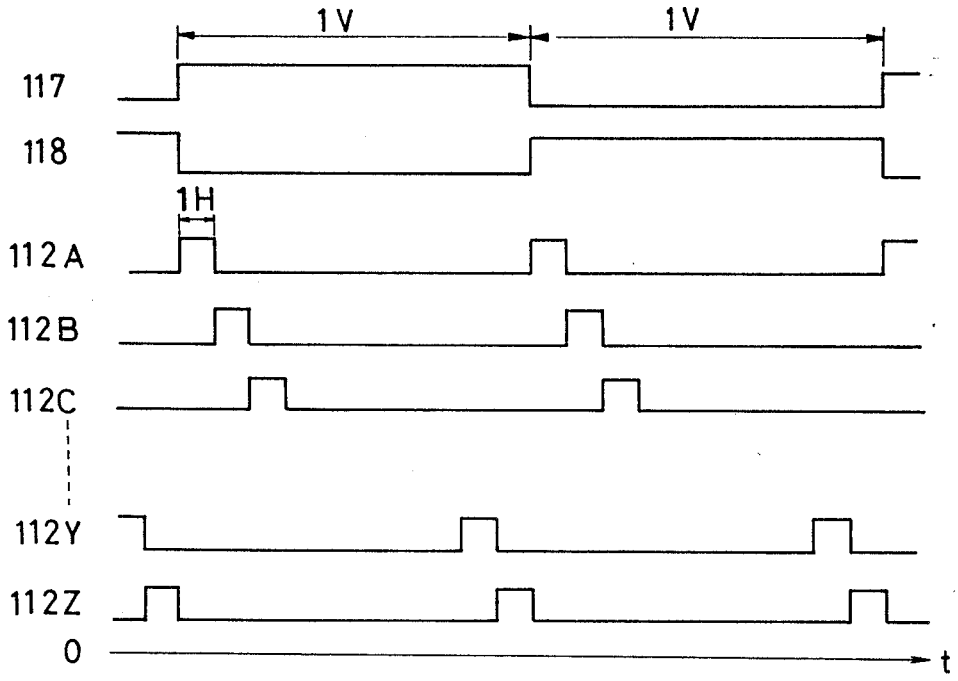
FIG.3(B)(Prior Art)
FIG. 3(B) is the time chart showing waveforms of the signals which are applied to the electrodes shown in FIG. 3(A).
Figure 4:
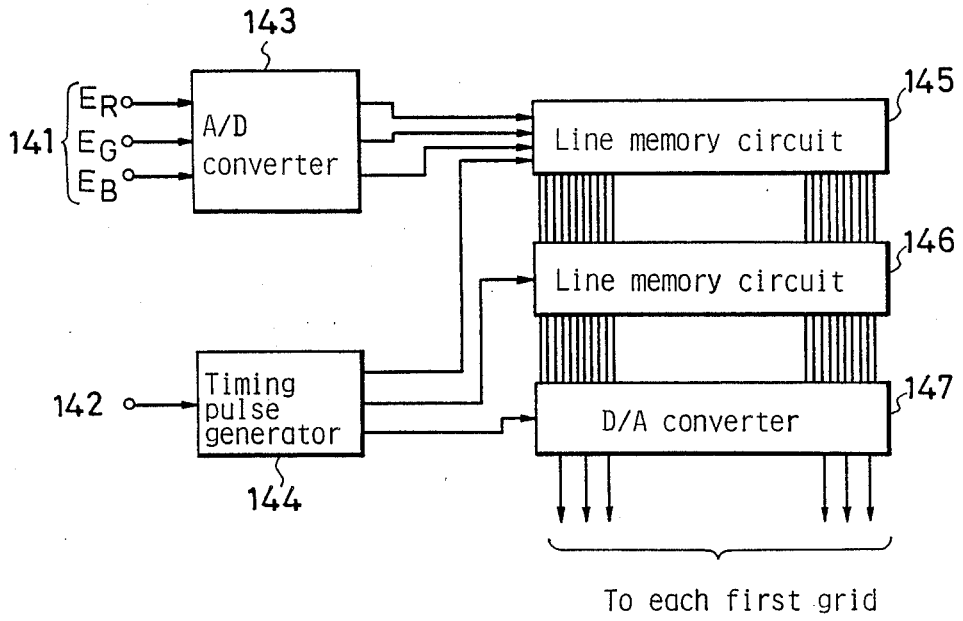
FIG.4 (Prior Art)
FIG. 4 is the block diagram showing the video signal processing system of the conventional flat type cathode ray tube.
Figure 5:
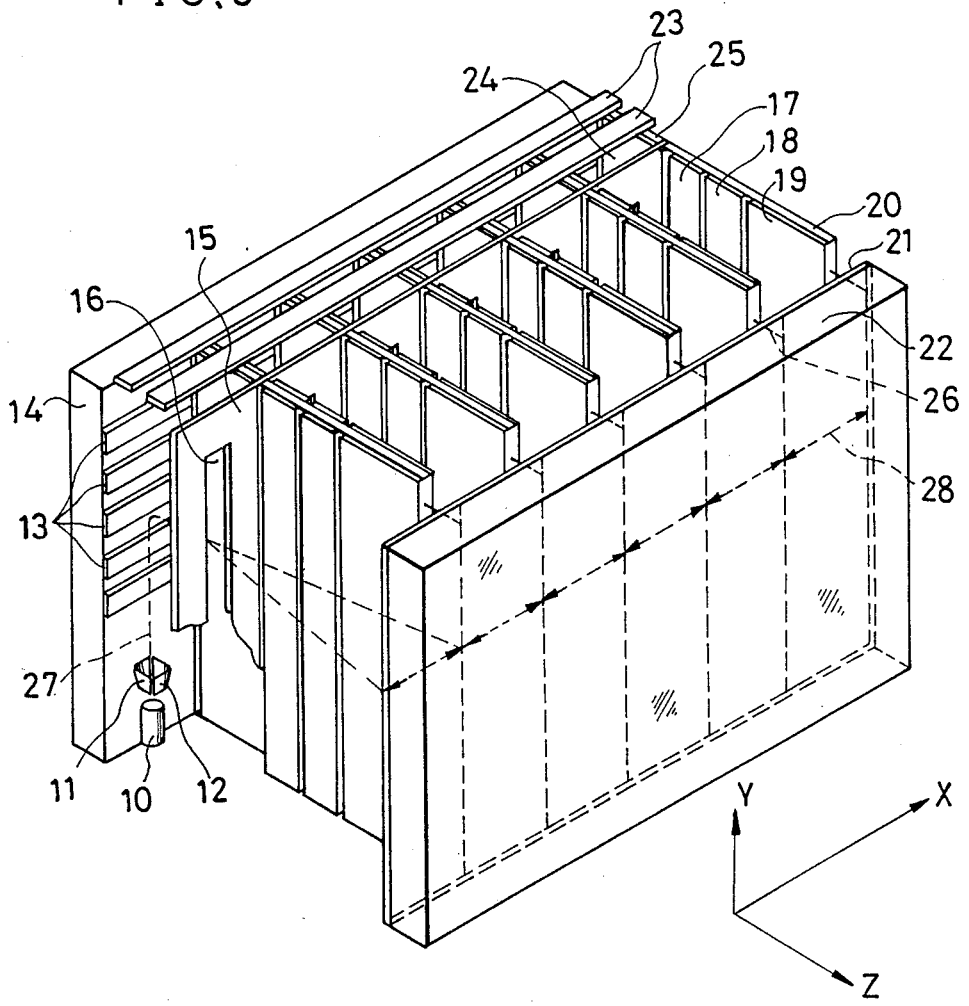
FIG. 5 is a partial perspective view showing an embodiment of a flat type cathode ray tube in accordance with the present invention.
Figure 6A:
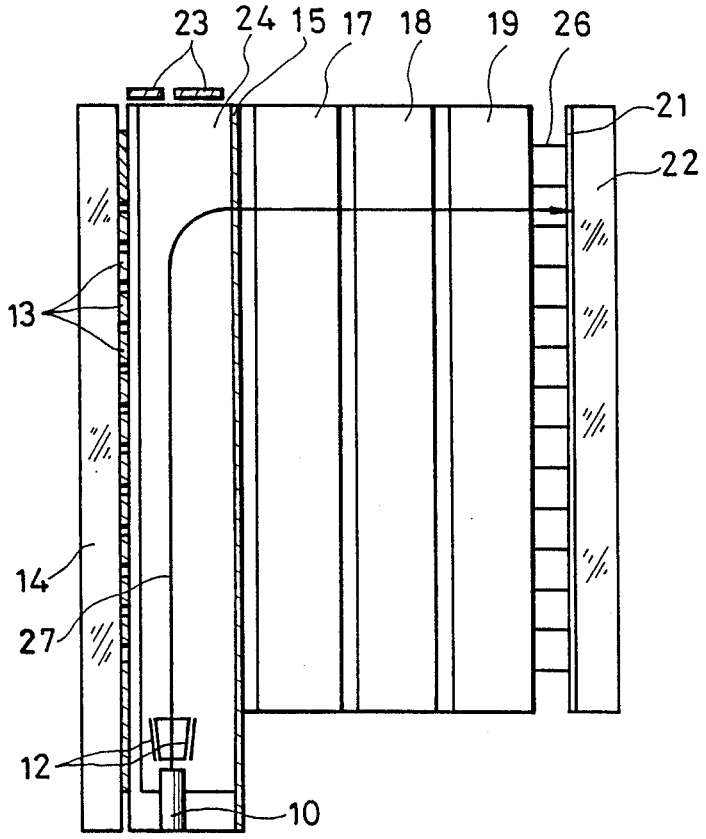
FIG. 6(A) is a partial vertical sectional view of a flat type cathode ray tube of FIG. 5.
Figure 6B:
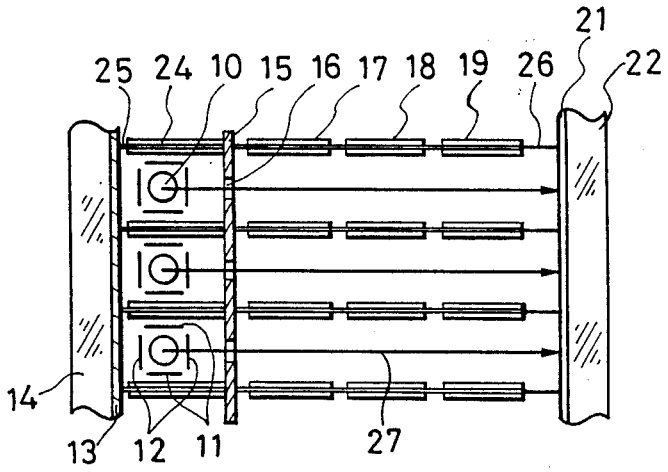
FIG. 6(B) is a partial horizontal sectional view of a flat type cathode ray tube of FIG. 6.
Figure 7:
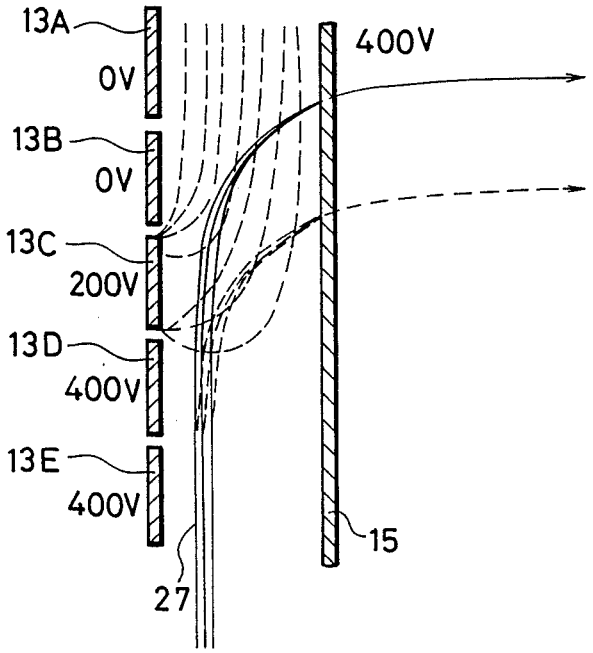
FIG. 7 is a partial vertical sectional view showing vertical deflection and focussing of a flat type cathode ray tube of FIG. 5.

Hereafter, a preferred embodiment of the present invention is described with reference to the accompanying drawings. FIG. 5 is a perspective view showing a partial construction of inner electrodes of a cathode ray tube. FIG. 6(A) and FIG. 6(B) are a partial vertical (Y-direction) sectional view and a partial horizontal (X-direction) sectional view of FIG. 5, respectively. In FIG. 5, the flat type cathode ray tube has a vacuum enclosure (shown only partly) which comprises an optically transparent face plate 22, a rear plate 14, an upper plate (not shown), a bottom plate (not shown) and both side plates (not shown). The inner space of the vacuum enclosure is separated into plural uniform size unit spaces by means of supporters 20 and 25 made of insulating material (for example a glass) and metal pins 26, with the rear end of the supporter 25 being in contact with the rear plate 14, and the front end of the supporter 25 and the rear end of the supporter 20 being in contact with a shield electrode 15 from opposite directions. The metal pins 26 are attached in the front end of the supporter 20 and lined up vertically with regular intervals, and tips of the metal pins 26 are in contact with the face plate 22 thereby to support the face place 22 against the force caused by atmospheric pressure on the vacuum enclosure to prevent implosion between the face plate 22 and the rear plate 14. In each unit space, there exists an electron beam source 10, and therefrom an electron beam 27 is emitted upward (Y-direction of FIG. 5). Intensities of each electron beam 27 is modulated by video signals which are applied to the electron beam source 10. The shield electrode 15 is disposed in parallel to the rear plate, and nearer to the rear plate 14 than the face plate 22, and has vertically (in Y-direction of FIG. 5) long slit apertures 16 in each compartment of the unit. Vertical scanning electrodes 13, which are long strips in the horizontal direction (X-direction of FIG. 5) and are separated to be insulated from each other, are vertically lined up (or integrally formed) on the rear plate 14. The number of the vertical scanning electrodes 13 is selected to be at least the number of effective horizontal scanning lines for one field (about 240 in the case of standard NTSC TV system). By making the vertical scanning electrodes 13, the shield electrode 15 and charge-up-prevention electrode 24 equipotential with each other, the electron beam 27 travels straight upwardly through field-free space. In order to deflect the electron beam 27 to the aperture 16 of the shield electrode 15 as shown in FIGS. 6(A) and 6(B), the potential of the vertical scanning electrode 13, which is in parallel with the electron beam 27, is made equal to the potential of a cathode (not shown) of the electron beam source 10, as shown in FIG. 7. When normal state potentials of the shield electrode 15 and the vertical scanning electrodes 13 are made to be 400 V, and potentials of the vertical scanning electrodes 13A and 13B are made to be the potential of the cathode of the electron beam source 10, namely 0 V, and potential of the vertical scanning electrode 13C is made an intermediate voltage, namely 200 V, the electron beam 27 is deflected toward the shield electrode 15 by electric field shown by broken lines in FIG. 7.

Figure 8:
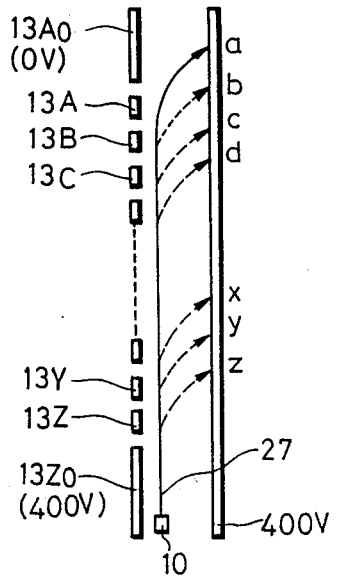
FIG. 8(A) is a partial vertical side view showing vertical scanning operation of a flat type cathode ray tube of FIG. 5.
FIG. 8(B) is a time chart showing waveforms of signals which are applied to electrodes shown in FIG. 8(A).
Figure 8:
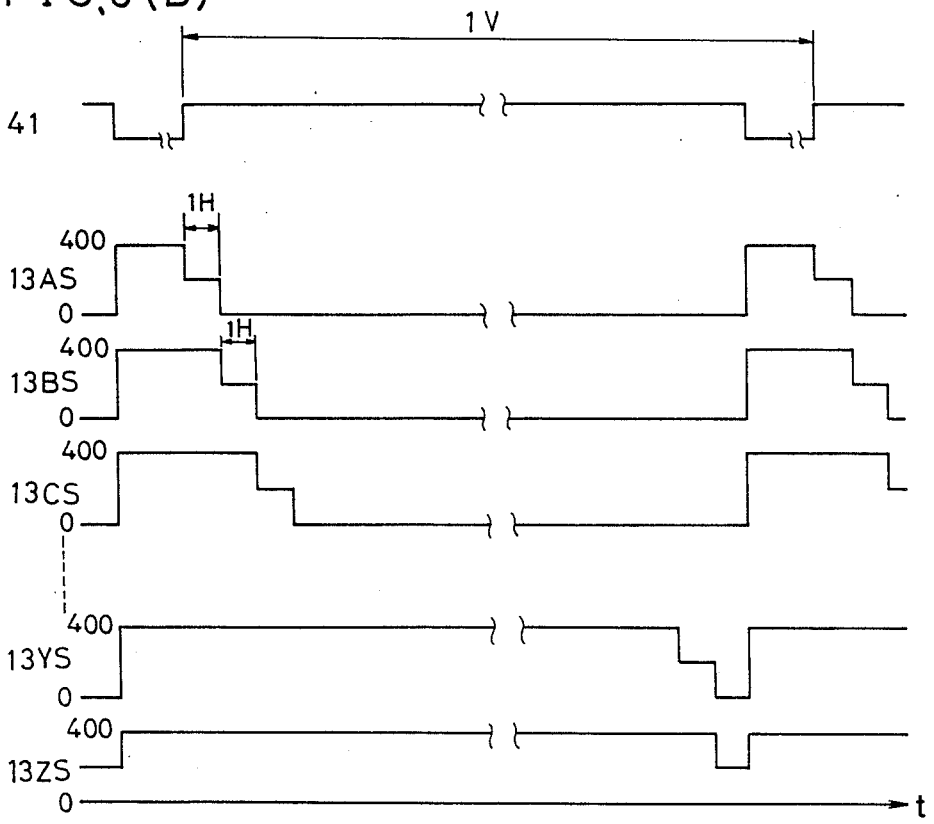

Based on the above, vertical scanning operation is described with reference to FIG. 8(A) and FIG. 8(B). A width of the uppermost one 13Ao of the vertical scanning electrodes 13 and the lowermost one 13Zo are made larger in size than other vertical scanning electrodes from 13Bo to 13Yo as shown in FIG. 6(A). The uppermost electrode 13Ao and the lowermost electrode 13Zo are always impressed with fixed voltages of 0 V and 400 V, respectively. In FIG. 8(B), a time chart 41 shows an effective scanning period in one field period (1V). The subsequent waveforms shows voltages which are applied to the vertical scanning electrodes 13A–13Z are designated by attaching suffixes S, as 13AS–13ZS, respectively. When potential of the vertical scanning electrode 13A is made 200 V, incident position of the electron beam 27 is made on a position "a" of the shield electrode 15. After one horizontal scanning period (1H), by making potentials of the vertical scanning electrodes 13A and 13B, 0 V and 200 V, respectively, incident position of the electron beam 27 is made on a position "b" of the shield electrode 15. Thus, by changing voltages which are applied to the vertical scanning electrodes 13C–13Z in a predetermined order, incident positions of the electron beams 27 are shifted from "a" to "z", and thereby one field scanning is completed. At that time, vertical intervals of incident positions are corresponded with the intervals of the vertical scanning electrodes 13. In an ordinary TV set using interlaced scanning, in the subsequent second field, applied voltages to the vertical scanning electrodes 13A–13Z should be lowered less than 200 V so that incident positions of the electron beams are positioned alternating with those of the first field.

As shown in FIG. 5, the electron beams 27 which are passed through the aperture 16 of the shield electrode 15 are scanned horizontally within a width of one unit (shown by an arrow 28) by horizontal focussing and deflection electrodes 17, 18 and 19 which are attached on the supporter 20. These electrodes 17, 18 and 19 can be made on the supporter 20 by a known process of vacuum evaporation, screen printing or sputtering. The supporter 20 is made of insulating materials, for example glass or ceramic etc..

Figure 9:
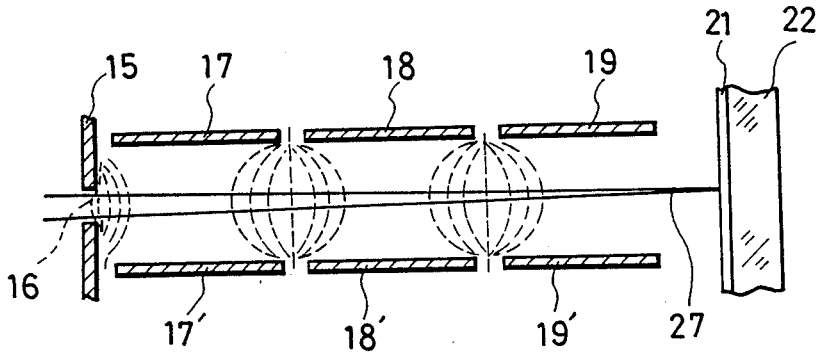
FIG. 9 is a partial horizontal sectional view showing horizontal focussing operation of a flat type cathode ray tube of FIG. 5.
Figure 10:
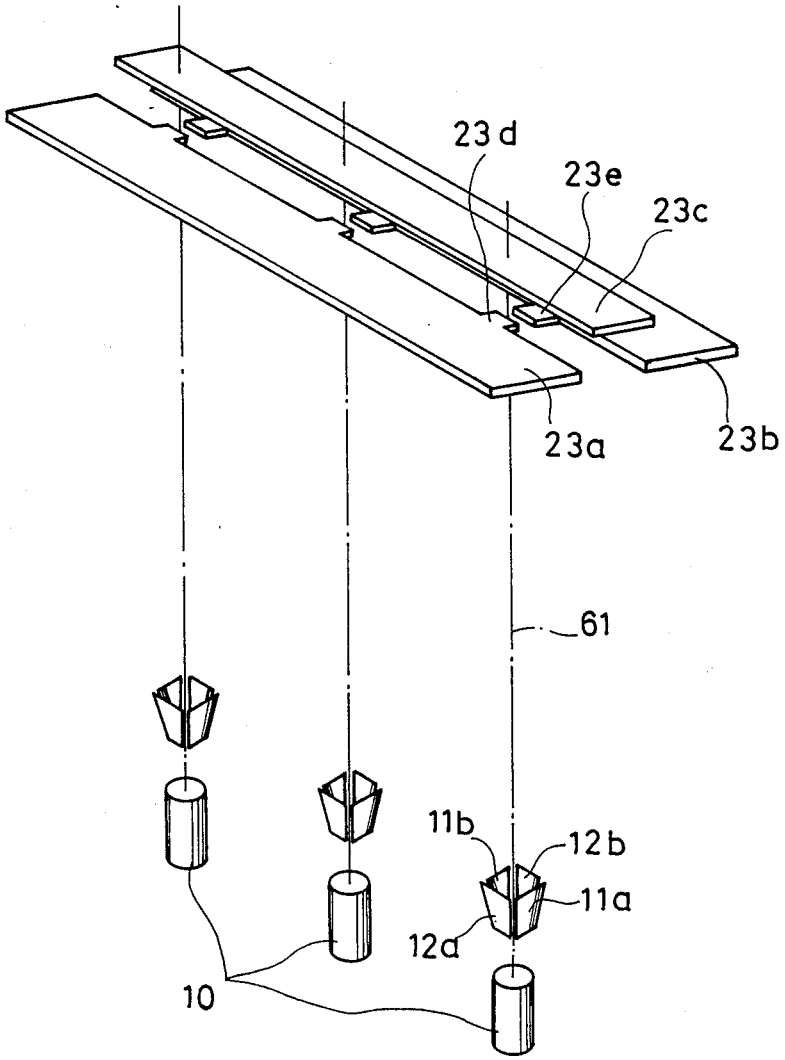
FIG. 10 is a partial perspective view showing control of electron beams of a flat type cathode ray tube of FIG. 5.

As shown in FIG. 9, the horizontal focussing and deflection electrodes 17, 18 and 19 are impressed with predetermined voltages, respectively. And thereby, the electron beam 27, which is passed through the aperture 16 of the shield electrode 15, is focused into a small spot on a phosphor screen 21. And simultaneously, the same voltage of a saw-tooth wave, step like wave for 1H period or triangle wave for 2H period is superimposed on respective horizontal focusing and deflection electrodes 17, 18 and 19 (inverted voltage is applied to opposite horizontal focussing and deflection electrode 17', 18' and 19'). And thereby, the electron beam 27 is deflected horizontally. At that time, the horizontal focussing and deflection electrodes 19 and 19' are impressed with a d.c. voltage which is substantially the same voltage as that applied to a metal back electrode (not shown) of the phosphor screen 21; and the horizontal focussing and deflection electrodes 18 and 18' are impressed with substantially a half potential of that of the metal back electrode; and the horizontal focussing and deflection electrodes 17 and 17' are impressed with a voltage whereby electron beams are focused into a minimum spot on the phosphor screen 21. In FIG. 10, electron beam position detecting electrodes 23*a* and 23*b* having projections 23*d* and 23*e*, respectively, or slit like apertures (not shown) are symmetrically disposed across a center line 61 of each electron beam source 10. This is in order that the electron beam 27 (FIG. 5) is guided upward in parallel with the vertical scanning electrodes 13, and vertical focussing positions of each electron beam 27 on the phosphor screen 21 (FIG. 9) becomes coincident each other at any vertical scanning position, and the electron beam 27 is guided to a center of the aperture 16 (FIG. 5) of the shield electrode 15 (FIG. 5). When electron beam current is kept constant, the electron beam 27 (FIG. 6(A)) can travel in parallel with the vertical scanning electrodes 13 (FIG. 6(A)) by adjusting voltages applied to auxiliary deflection electrodes 12*a* and 12*b* in a manner to make the electron beam currents which flow into the electron beam position detecting electrodes 23*a* and 23*b* equal to each other. Further, the projections 23*d* and 23*e* are provided only at a position near the centerline 61 of the electron beam source 10 on the electron beam position detecting electrodes 23*a* and 23*b*, respectively, and control voltages are applied to auxiliary deflection electrodes 11*a* and 11*b* so that the electron beam currents which flow into the electron beam position detecting electrodes 23*a* and 23*b* are made maximum and equal. Thereby, the electron beam 27 (FIG. 5) can be passed through the horizontal center of the aperture 16 (FIG. 5) in the shield electrode 15 (FIG. 5). The above-mentioned control is carried out by individual electron beam source 10. An electron beam catching electrode 23*c* is provided for catching electron beam 27 (FIG. 5) which are passed through a gap between the electron beam position detecting electrodes 23*a* and 23*b*; but it is not always necessary.

Figure 11:
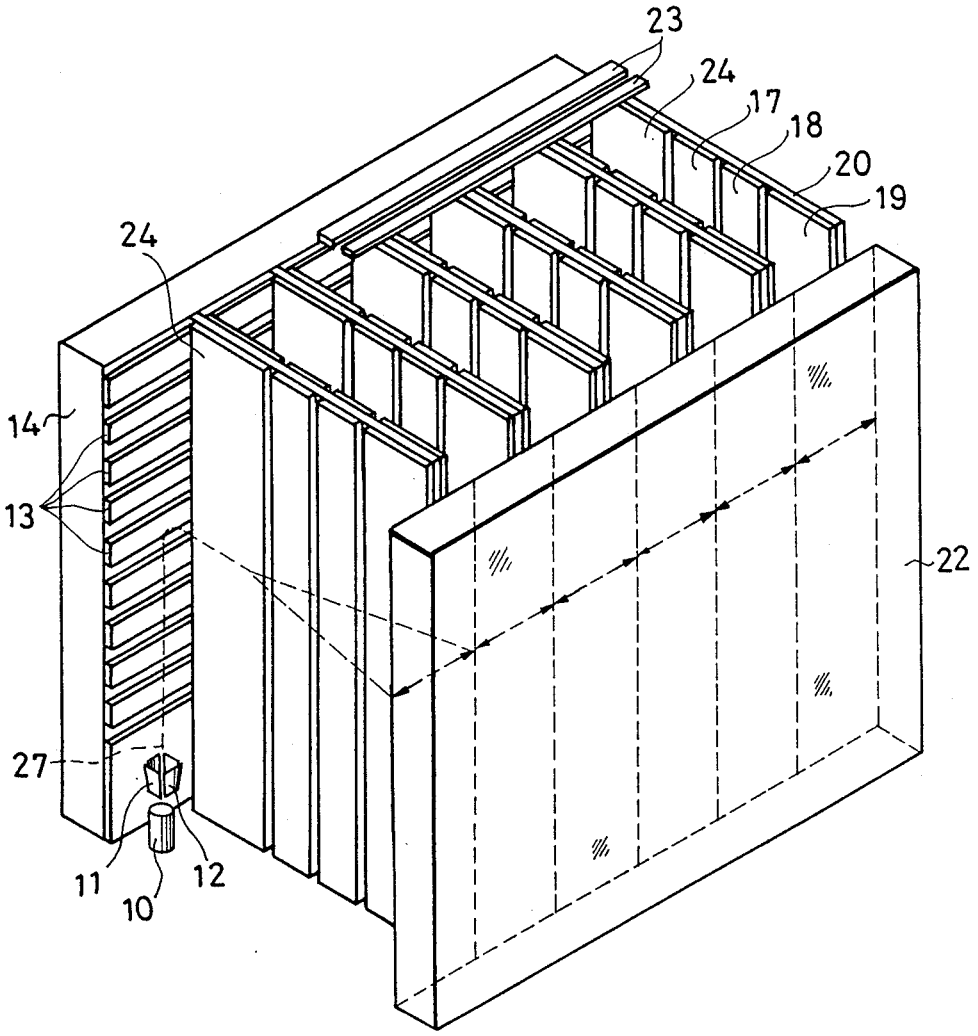
FIG. 11 is a partial perspective view showing another embodiment of a flat type cathode ray tube in accordance with the present invention.

FIG. 11 is a partial perspective view showing another embodiment of a flat type cathode ray tube of the present invention. In this embodiment, the shield electrode 15 (FIG. 5) is removed from the first embodiment shown in FIG. 5. In FIG. 11, width of an charge-up-prevention electrode is made wide, and voltages which are applied to the horizontal focussing and deflection electrode 17 are adjusted so as not to affect potentials of the electron beam 27 which travel upward. Since other parts of this embodiment are identical with those of the first embodiment, description for them are omitted.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

We claim:

1. A flat type cathode ray tube comprising:

a phosphor screen;

a plurality of vertical scanning electrodes which each have an oblong configuration in the horizontal direction and are separated from each other in the vertical direction, the plurality of vertically separated scanning electrodes forming a plane which is substantially parallel to said phosphor screen, said electrodes for vertically scanning electron beams onto said phosphor screen by changing potentials which are to be applied to respective electrodes;

a plate-shaped shield electrode, disposed between said vertical scanning electrodes and said screen, and having inner surfaces that define a plurality of slit apertures for passing electron beams in each of a plurality of partitioned spaces;

a plurality of first supporting means for partitioning into said plurality of partitioned spaces, said first supporting means being separated from one another in the horizontal direction and being disposed between said phosphor screen and said shield electrode and arranged in parallel in the horizontal direction;

a plurality of horizontal focusing and deflection electrodes, each attached to each surface of a first supporting means, for horizontally scanning and focusing electron beams within predetermined ranges onto said phosphor screen;

a plurality of second supporting means which are disposed between said vertical scanning electrodes and said shield electrode in locations corresponding to locations of each of said first supporting means and separated therefrom, to form corresponding partitioned spaces across said shield electrode, each of said second supporting means having a conductive surface thereon;

a plurality of electron beam emitting means which are disposed between said vertical scanning electrodes and said shield electrode, one to correspond to each said corresponding partitioned space formed between said second supporting means for emitting electron beams in a substantially vertical direction substantially in parallel with said plane formed by said vertical scanning electrodes, vacuum enclosure means for enclosing the above-mentioned parts.

2. A flat cathode ray tube in accordance with claim 1, wherein said electron beam emitting means includes a plurality of auxiliary deflection electrodes for adjusting each course of each electron beam.

3. A flat type cathode ray tube in accordance with claim 1, wherein said vacuum enclosure comprises a face plate on which said phosphor screen is provided and a rear plate on which said vertical scanning electrodes are provided, and said face plate and said rear plate are disposed to oppose each other across said first supporting means, said shield electrode and said second supporting means, to withstand atmospheric pressure.

4. A flat type cathode ray tube in accordance with claim 1, further comprising:

applying means for sequentially impressing deflection voltages to ones of said vertical scanning electrodes, for deflecting and vertically focusing electron beams to said phosphor screen.

5. A flat type cathode ray tube in accordance with claim 1, wherein said horizontal focusing and deflection electrodes are separated into plural electrodes in a traveling direction of electron beams, said plural electrodes being impressed with different d.c. voltages from each other and with the same deflection voltage.

6. A flat type cathode ray tube comprising:

a phosphor screen;

a plurality of vertical scanning electrodes which each have an oblong configuration in the horizontal direction and are separated from each other in the vertical direction thereby to form a substantially parallel plane to said phosphor screen, said electrodes for vertically scanning electron beams onto said phosphor screen by changing potentials which are applied thereto;

a plurality of horizontal focussing and deflection electrodes which are disposed between said phosphor screen and said vertical scanning electrodes and are lined-up in parallel in the horizontal direction to thereby form a plurality of partitioned spaces therebetween, said horizontal electrodes for horizontally scanning and focussing electron beams within predetermined ranges onto said phosphor screen;

a plurality of electron beam emitting means which are disposed between said vertical scanning electrodes and said horizontal focussing and deflection electrodes in respective said partitioned spaces, for emitting electron beams in a substantially vertical direction along said plane formed by said vertical scanning electrodes;

a pair of electron beam position detecting electrodes, each of which is extended in the horizontal direction and has a plurality of projections in horizontal positions corresponding to said plurality of electron beam emitting means, to face said electron beam emitting means for detecting positions of electron beams which travel along said vertical scanning electrodes, said pair of electron beam position detecting electrodes being disposed opposite to each other across center lines of said electron beam emitting means with said projections opposed to each other with a predetermined gap therebetween; and vacuum enclosure means for enclosing the above-mentioned parts.

7. A flat type cathode ray tube in accordance with claim 6, wherein said electron beam emitting means has an auxiliary deflection electrode to which control voltages are applied for making beam currents which flow into said two electron beam position detecting electrodes maximum and equal.

8. A flat type cathode ray tube in accordance with claim 6, wherein said electron beam emitting means has auxiliary deflection electrodes for adjusting each course of electron beam.

9. A flat type cathode ray tube in accordance with claim 6, wherein said vacuum enclosure comprises a face plate on which said phosphor screen is provided and a rear plate on which said vertical scanning electrode is provided, and said horizontal focussing and deflection electrode has supporting means on an end thereof for supporting said face plate and rear plate against atmospheric pressure impressed thereto.

10. A flat type cathode ray tube in accordance with claim 7, further comprising:

applying means for sequentially impressing respective deflection voltages to said vertical scanning electrodes for deflecting and vertically focusing electron beams to said phosphor screen.

11. A flat type cathode ray tube in accordance with claim 7, wherein said horizontal focusing and deflection electrodes are separated into plural electrodes in a traveling direction of electron beams, said plural electrodes being impressed with different d.c. voltages from each other and the same deflection voltage.

12. A flat type cathode ray tube comprising:

a phosphor screen;

a plurality of vertical scanning electrodes which each have an oblong configuration in the horizontal direction and are separated from each other in the vertical direction thereby to form a substantially parallel plane to said phosphor screen, said electrodes for vertically scanning electron beams onto said phosphor screen by changing potentials which are applied thereto;

a plurality of horizontal focussing and deflection electrodes which are disposed between said phosphor screen and said vertical scanning electrodes and are lined-up in parallel in the horizontal direction to thereby form a plurality of partitioned spaces therebetween, said horizontal electrodes for horizontally scanning and focussing electron beams within predetermined ranges onto said phosphor screen;

a plurality of electron beam emitting means which are disposed along an extended surface of each said vertical scanning electrode in respective partitioned spaces, for emitting electron beams in a substantially vertical direction along said plane formed by said vertical scanning electrodes;

a plurality of auxiliary deflection electrodes, each for adjusting a position of electron beams which are emitted from said electron beam emitting means responsive to a control voltage applied thereto;

a pair of electron beam position detecting electrodes, each of which is disposed along an extended surface of said vertical scanning electrode to extend in the horizontal direction and faces said electron beam emitting means and has a plurality of projections in horizontal positions corresponding to said plurality of electron beam emitting means, for detecting positions of electron beams, said electron beam position detecting electrodes being disposed opposite to each other across center lines of said electron beam emitting means with said projections opposed to each other with a predetermined gap formed therebetween;

control means for controlling said control voltages which are applied to said auxiliary deflection electrodes based on said detected electron beam position to adjust electron beam currents which flow into said electron beam position detecting electrode to become maximum and equal; and vacuum enclosure means enclosing the above-mentioned parts.

13. A flat type cathode ray tube in accordance with claim 12, further comprising:

an electron beam catching electrode, which is disposed above said electron beam position detecting electrode, for detecting electron beams which are passed between said electron beam position detecting electrodes thereby to adjust said control voltages to said control means.

14. A flat type cathode ray tube in accordance with claim 12, wherein said vacuum enclosure comprises a faceplate whereon said phosphor screen is provided and a rear plate whereon said vertical scanning electrodes is provided, and said horizontal focussing and deflection electrodes has supporting means on an end thereof for supporting said faceplate and rear plate against atmospheric pressure impressed thereto.

15. A flat type cathode ray tube in accordance with claim 12, further comprising applying means for sequentially impressing deflection voltage to said vertical scanning electrode for deflecting and vertically focusing electron beams to said phosphor screen.

16. A flat type cathode ray tube in accordance with claim 12, wherein said horizontal focusing and deflection electrodes are separated into plural electrodes in a traveling direction of electron beams, said plural electrodes being impressed with different d.c. voltages from each other and the same deflection voltage.

17. A flat type cathode ray tube in accordance with claim 1, further comprising:

means for maintaining said conductive surface of the second supporting means at equipotential to said shield electrode and electrically insulated from said vertical scanning electrodes.

18. A flat type cathode ray tube comprising:

a phosphor screen;

a plurality of vertical scanning electrodes which each have an oblong configuration in the horizontal direction and are separated from each other in the vertical direction thereby to form a substantially parallel plane to said phosphor screen, said electrodes for vertically scanning electron beams onto said phosphor screen by changing potentials which are applied thereto;

a plurality of horizontal focussing and deflection electrodes which are disposed between said phosphor screen and said vertical scanning electrodes and are lined-up in parallel in the horizontal direction to thereby form a plurality of partitioned spaces therebetween, said horizontal electrodes for horizontally scanning and focussing electron beams within predetermined ranges onto said phosphor screen;

a plurality of electron beam emitting means which are disposed between said vertical scanning electrodes and said horizontal focussing and deflection electrodes in respective said partitioned spaces, for emitting electron beams in a substantially vertical direction along said plane formed by said vertical scanning electrodes;

a pair of electron beam position detecting electrodes which are extended in the horizontal direction and disposed to face said electron beam emitting means for detecting positions of electron beams which travel along said vertical scanning electrode, said pair of electron beam position detecting electrodes being disposed opposite to each other across center lines of said electron beam emitting means;

vacuum enclosure means for enclosing the above-mentioned parts;

a plate shaped shield electrode, disposed between said vertical scanning electrodes and said screen, and having inner surfaces that define a plurality of slit apertures for passing electron beams in each of a plurality of said partitioned spaces;

a plurality of first supporting means for partitioning into said plurality of partitioned spaces, said first supporting means being separated from one another in the horizontal direction and being disposed between said phosphor screen and said shield electrode; and a plurality of second supporting means, disposed between said vertical scanning electrodes and said shield electrodes in locations to correspond to locations of each of said first supporting means to form corresponding partitioned spaces across said shield electrode, each said second supporting means having a conductive surface thereon and separated from each said first supporting means, wherein each of said plurality of electron beam emitting means emits an electron beam in one of said corresponding partitioned spaces.

19. A flat type cathode ray tube comprising:

a phosphor screen;

a plurality of vertical scanning electrodes which each have an oblong configuration in the horizontal direction and are separated from each other in the vertical direction thereby to form a substantially parallel plane to said phosphor screen, said electrodes for vertically scanning electron beams onto said phosphor screen by changing potentials which are applied thereto;

a plurality of horizontal focussing and deflection electrodes which are disposed between said phosphor screen and said vertical scanning electrodes and are lined-up in parallel in the horizontal direction to thereby form a plurality of partitioned spaces therebetween, said horizontal electrodes for horizontally scanning and focussing electron beams within predetermined ranges onto said phosphor screen;

a plurality of electron beam emitting means which are disposed along an extended surface of each said vertical scanning electrode in respective partitioned spaces, for emitting electron beams in a substantially vertical direction along said plane formed by said vertical scanning electrode;

a plurality of auxiliary deflection electrodes, each for adjusting a position of electron beams which are emitted from said electron beam emitting means responsive to a control voltage applied thereto;

a pair of electron beam position detecting electrodes which are disposed along an extended surface of said vertical scanning electrode to extend in the horizontal direction and face said electron beam emitting means for detecting positions of electron beams, said electron beam position detecting electrodes being disposed opposite to each other across center lines of said electron beam emitting means;

control means for controlling said control voltages which are applied to said auxiliary deflection electrodes based on said detected electron beam position to adjust electron beam currents which flow into said electron beam position detecting electrode to become maximum and equal;

vacuum enclosure means enclosing the above-mentioned parts;

a plate shaped shield electrode, disposed between said vertical scanning electrodes and said screen, and having inner surfaces that define a plurality of slit apertures for passing electron beams in each of a plurality of said partitioned spaces;

a plurality of first supporting means for partitioning into said plurality of partitioned spaces, said first supporting means being separated from one another in the horizontal direction and being disposed between said phosphor screen and said shield electrode; and a plurality of second supporting means, disposed between said vertical scanning electrodes and said shield electrodes in locations to correspond to locations of each of said first supporting means to form corresponding partitioned spaces across said shield electrode, each said second supporting means having a conductive surface thereon and separated from each said first supporting means, wherein each of said plurality of electron beam emitting means emits an electron beam in one of said corresponding partitioned spaces.

20. A cathode ray tube as in claim 1 wherein each said electron beam emitting means includes means for emitting a necessary amount of electron beam to irradiate said screen.

* * * * *